US006105210A

United States Patent [19]

Benoit

[11] Patent Number: 6,105,210

[45] **Date of Patent: *Aug. 22, 2000**

[54] MERCHANDISE PAIRING TIE

[75] Inventor: James C. Benoit, Needham, Mass.

[73] Assignee: Avery Dennison Corporation, Pasadena, Calif.

[ * ] Notice: This patent is subject to a terminal disclaimer.

[21] Appl. No.: 09/268,914

[22] Filed: Mar. 16, 1999

Related U.S. Application Data

[63] Continuation-in-part of application No. 09/111,937, Jul. 8, 1998.

[51] Int. Cl.[7] ..... B65D 63/00; A43C 11/00

[52] U.S. Cl. ..... 24/16 PB; 24/17 AP; 24/30.5 P; 24/712.2; 36/1

[58] Field of Search ..... 24/16 PB, 17 AP, 24/30.5 P, 712.1, 712.2, 306; 36/1

[56] References Cited

U.S. PATENT DOCUMENTS

| | | | |
|---|---|---|---|
| 3,570,497 | 3/1971 | Lemole | 24/16 PB |
| 3,712,655 | 1/1973 | Fuehrer . | |
| 3,766,608 | 10/1973 | Fay . | |
| 3,816,879 | 6/1974 | Merser et al. . | |
| 3,983,603 | 10/1976 | Joyce | 24/16 PB |
| 4,001,898 | 1/1977 | Caveney . | |
| 4,003,106 | 1/1977 | Schumacher et al. . | |
| 4,240,183 | 12/1980 | Sumimoto et al. . | |
| 4,263,697 | 4/1981 | Speedie | 24/16 PB |
| 4,347,648 | 9/1982 | Dekkers . | |
| 4,680,836 | 7/1987 | Wisecup . | |
| 4,688,302 | 8/1987 | Caveney et al. . | |
| 4,728,064 | 3/1988 | Caveney . | |
| 4,754,529 | 7/1988 | Paradis . | |
| 4,951,362 | 8/1990 | Denemark et al. . | |
| 5,135,188 | 8/1992 | Anderson et al. . | |
| 5,154,376 | 10/1992 | Baum et al. . | |
| 5,685,048 | 11/1997 | Benoit . | |

FOREIGN PATENT DOCUMENTS

| | | |
|---|---|---|
| 2058194 | 8/1980 | United Kingdom . |

OTHER PUBLICATIONS

Brochure, Catamount Manufacturing Incorporated, Restricted Bundle Cable Tie, p. 7.

*Primary Examiner*—Victor N. Sakran
*Attorney, Agent, or Firm*—Kriegsman & Kriegsman

[57] ABSTRACT

A tie for use in pairing together two objects. The tie comprises a head having an elongated channel extending therethrough, a locking tang within the head, and a strap having a length of approximately 63.3 cm. The strap comprises a first end integrally formed onto the head and a second end. A projection is formed on the strap between the first end and the second end. The portion of the strap from the projection to the first end is in the form of an elongated, flexible filament having a length of approximately 59.5 cm. The elongated filament is narrow in thickness, narrow in width and has a generally uniform, rectangularly-shaped cross-section. In one embodiment, the portion of the strap from the projection to the second end is formed in a ladder structure having a plurality of rungs. The rungs of the strap are sequentially engaged by the locking tang when the strap is inserted into and through the elongated channel to form a closed loop. As the strap is further inserted through the elongated channel, the size of the closed loop is decreased. The projection serves as a stop to limit the minimum size of the closed loop which can be formed when the strap is inserted into the head.

4 Claims, 6 Drawing Sheets

MERCHANDISE PAIRING TIE

CROSS-REFERENCE TO RELATED APPLICATIONS

The present application is a continuation-in-part of presently pending U.S. patant application Ser. No. 09/111,937, filed Jul. 8, 1998, in the name of James C. Benoit, which is herein incorporated by reference.

BACKGROUND OF THE INVENTION

The present invention relates to a tie for pairing together two objects such as shoes or sneakers or gloves.

Ties are widely used for the bundling of objects such as a group of wires. One known tie comprises a serrated strap that is fitted to an apertured head containing an internal pawl or locking tang that engages the serrations of the strap. Another known tie is in the form of an apertured, or ladder, strap fitted to a buckle-like head, with a tongue that enters the apertures of the strap.

In U.S. Pat. No. 3,766,608 to Fay, which is incorporated herein by reference, there is disclosed a tie formed by a locking head and an attached ladder strap. The head contains a longitudinal guide channel for receiving the strap, after encirclement of items to be bundled, and an internal locking tang. The latter is deflected with respect to relatively narrow auxiliary channels on opposite sides of the guide channel. One of the auxiliary channels receives the locking tang during the bundling of the items; the other auxiliary channel contains a stop against which the locking tang becomes abutted in planar engagement by the reverse thrust of the harnessed items.

In U.S. Pat. No. 4,347,648 to Dekkers, which is incorporated herein by reference, there is disclosed a tie formed by a locking head and an attached ladder strap. The head contains a locking tang and a guide channel that receives the strap after encirclement of items to be bundled. The tang engages the rungs of the ladder strap for the adjustable retention of the items. The free end of the strap has a light-weight webbed tail that facilitates the insertion of the strap into the head. The strap is advantageously molded of a stretch reorientable material and is subsequently stretched to produce a suitable strengthening and elongation of the webbed tail.

Ties have been found to be very useful and effective in bundling objects together. In addition, some ties, particularly the tie described in U.S. Pat. No. 4,347,648 to Dekkers, have also been used as a tie to pair together articles of commerce, such as pairs of shoes. Used in this manner, the tie does not hold the pair of articles together in a bundle but rather serves to keep the two pieces of merchandise together. In this capacity, the tie has been found to be very a useful device, for example, in displaying a pair of shoes for sale.

To use a tie of the type described above to pair together a pair of shoes, the tail end of the strap is inserted through an eyelet or under the shoelace of each shoe. The tail is then inserted through the guide channel of the head so that the strap forms a closed loop. As the strap is further drawn forward through the guide channel of the head, the closed loop decreases in size.

It should be noted that if the strap is drawn too far forward through the guide channel of the head, the size of the closed loop of the tie will become too small to enable a prospective buyer to comfortably put on both shoes at the same time because the two shoes will be too close to each other.

Accordingly, in U.S. Pat. No. 5,685,048 to J. C. Benoit, which is incorporated herein by reference, there is disclosed a merchandise pairing tie for use in pairing together two objects. The tie comprises a head having an elongated channel extending therethrough, a locking tang within the head, and a strap extending from the head. The strap is approximately 30 cm in length and is formed in a ladder structure having a plurality of rungs. The rungs of the strap are sequentially engaged by the locking tang when the strap is inserted into and through the elongated channel to form a closed loop. As the strap is further inserted through the elongated channel, the size of the closed loop is decreased. The tie further includes a projection formed on a rung of the strap and located approximately 26 cm from the head. The projection protrudes upward from the rung approximately 1 mm and serves as a stop to limit the minimum size of the closed loop which can be formed when the strap is inserted into the head.

SUMMARY OF THE INVENTION

It is an object of the present invention to provide a new tie of the type having a locking head and an attached strap.

It is another object of the present invention to provide a tie as described above which is particularly useful in pairing two objects.

It is still another object of the present invention to provide a tie as described above which is inexpensive to manufacture and easy to use.

Accordingly, there is provided a tie for pairing together two objects comprising a head having an elongated channel extending therethrough, a locking tang within said head, a strap having a first end and a second end, the first end being integrally formed onto said head, and a projection formed on said strap between the first end and the second end, the portion of said strap from said projection to the first end being in the shape of a filament, the portion of said strap from said projection to the second end being engagable by said locking tang when said strap is inserted into and through the elongated channel to form a closed loop, wherein increased insertion of said strap through the elongated channel decreases the size of the closed loop, said projection limiting the minimum size of the closed loop which can be formed.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings, wherein like reference numerals represent like parts.

DETAILED DESCRIPTION OF A PREFERRED EMBODIMENT

Figure 1:
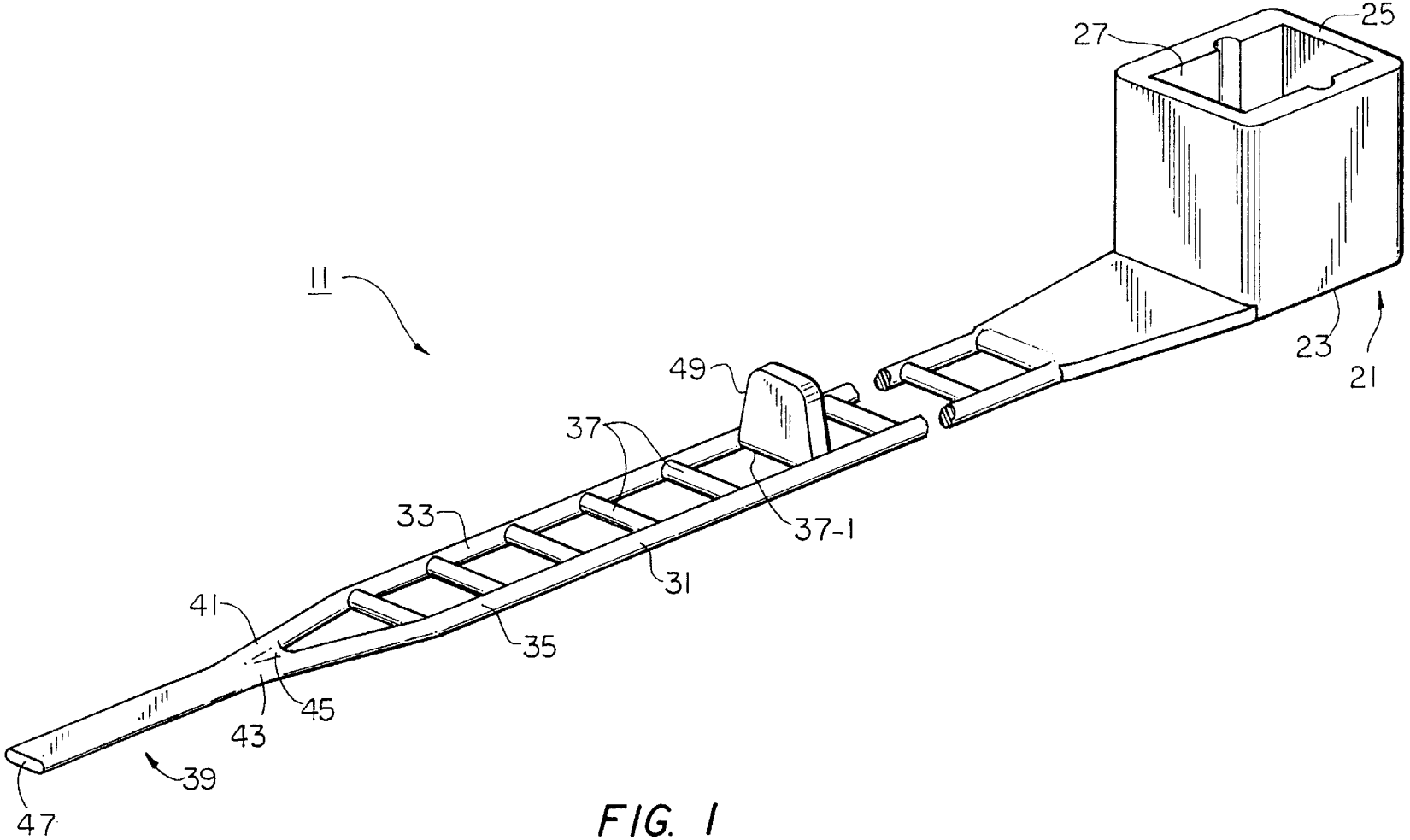
FIG. 1 PRIOR ART
FIG. 1 is a perspective view of a prior art tie for pairing together two objects.
Figure 2:
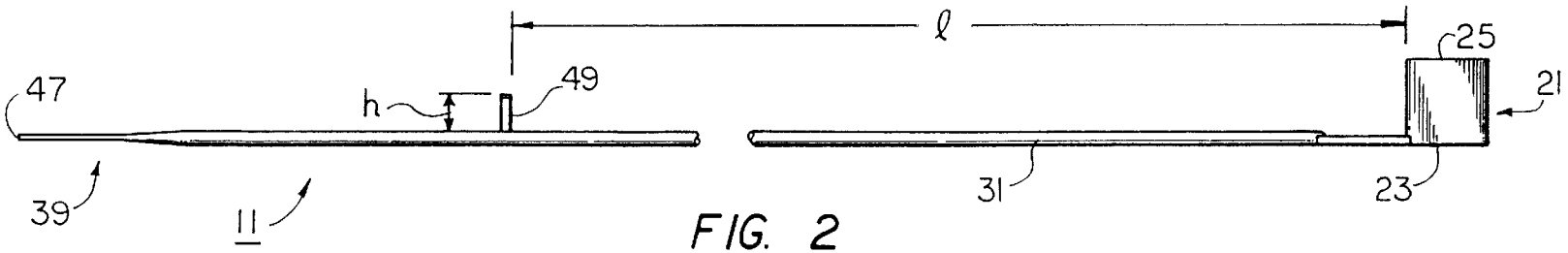
FIG. 2 PRIOR ART
FIG. 2 is a right side view of the prior art tie shown in FIG. 1.

Referring now to FIGS. 1 and 2, there are shown perspective and side views, respectively, of a prior art tie for pairing together two objects, the tie being represented generally by reference numeral 11. Prior art tie 11 is of the type disclosed in U.S. Pat. No. 5,685,048 to J. C. Benoit, which is incorporated herein by reference.

Prior art tie 11 includes a head 21 and an attached strap 31.

Figure 3:
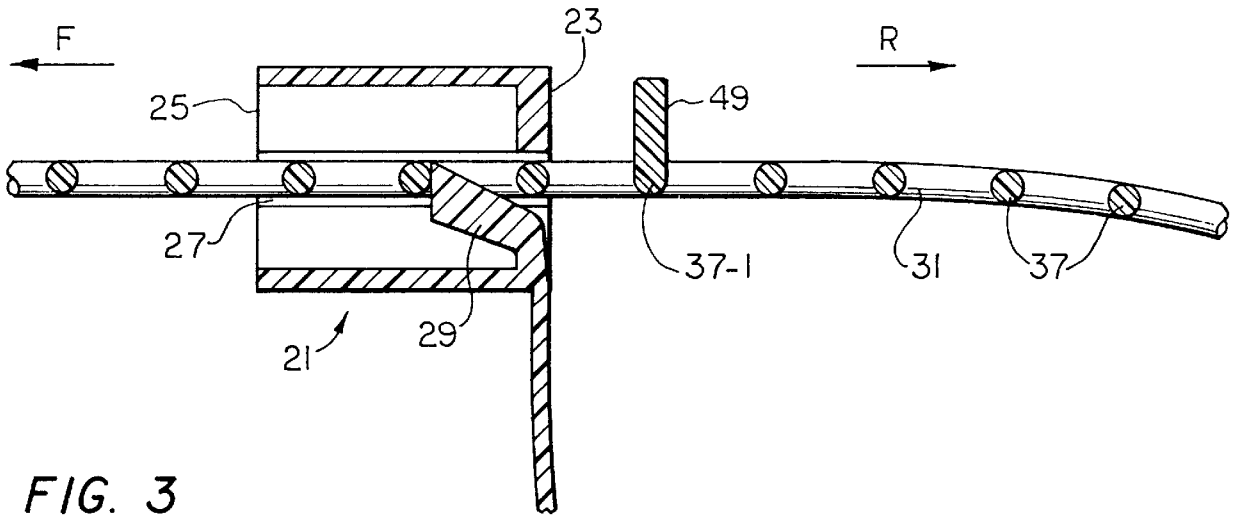
FIG. 3 PRIOR ART
FIG. 3 is a fragmentary, side section view of the prior art tie shown in FIG. 1, the strap being shown inserted through the head.

The internal structure of head 21 is shown in FIG. 3. Head 21 is generally rectangular in shape and includes a bottom wall 23, a top wall 25, and an elongated channel 27 which extends through head 21 from bottom wall 23 to top wall 25. Head 21 further includes a locking tang 29 which may be either of the stationary type or the deflectable type.

Strap 31 is constructed in the form of a ladder structure and is approximately 30 cm in length. Strap 31 comprises a pair of side rails 33 and 35 and a plurality of rungs 37. Strap 31 further includes a elongated webbed tail 39 integrally formed at its free end. Tail 39 is formed by extensions 41 and 43 of side rails 33 and 35, respectively. Webbing 45 occupies the interval between extension side rails 41 and 43. Tail 39 tapers into a narrow tip 47 approximately 1 mm in width.

Strap 31 can be molded and then stretched. Strap 31 is preferably constructed of a molecular reorientable type material, such as nylon, polypropylene, polyester, urethane, or the like. This material, upon stretching, not only reduces the volume per unit length of the strap but also provides enhanced physical properties. For example, there is increased strength in tensile and shear strength.

The particular construction of tail 39 must be noted. Webbing 45 facilitates production of prior art tie 11 with improved operating, molding and stretching characteristics. Because of webbing 45, the material inserted into the mold, which is advantageously accomplished by injection molding, has an enlarged channel for the flow of material, as compared with the standard ladder structure. The result is that imperfections that often attend molding, such as cold shuts, voids and nit marks are either eliminated or significantly reduced in extent.

Moreover, it must be noted that because tail 39 tapers into a narrow tip 47 of approximately 1 mm width, tail 39 can be threaded through relatively narrow openings, such as the eyelet of a shoe. This construction enables the user to pair together articles which have relatively small holes.

Referring to FIGS. 1 and 2, strap 31 further includes an upwardly extending projection 49. Projection 49 is formed on a rung 37-1 and is located at a distance 1 of approximately 26 cm from head 21. Projection 49 protrudes upward from rung 37-1 a distance h of approximately 1 mm. Projection 49 serves as a stop when prior art tie 11 is used to pair together two objects as will be described in detail below.

Prior art tie 11 may be used to pair together two objects such as shoes, sneakers, or sandals.

Figure 4:
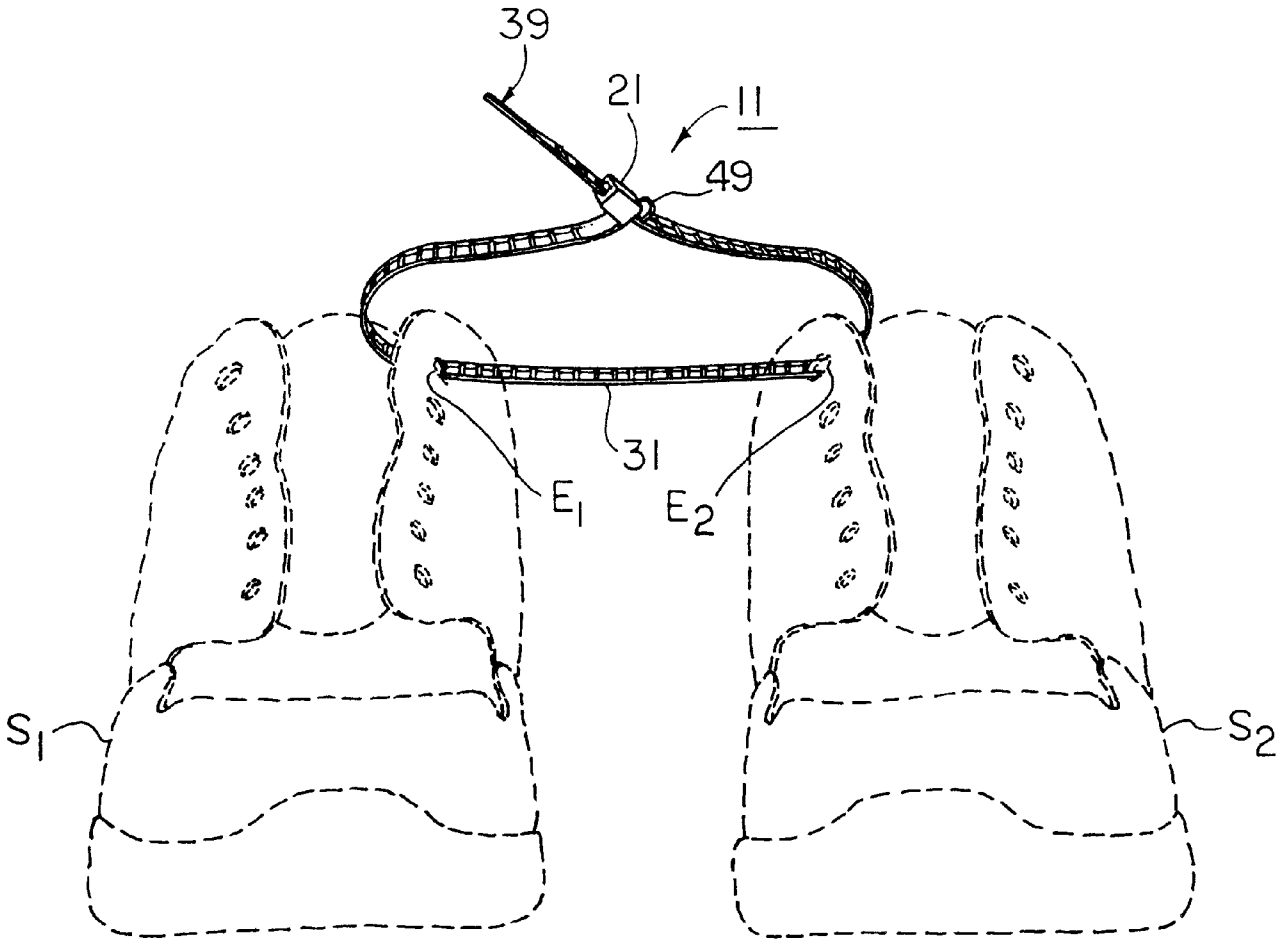
FIG. 4 PRIOR ART
FIG. 4 is a perspective view of the prior art tie shown in FIG. 1, the tie being shown pairing together two shoes.

Referring to FIG. 4, there is shown a pair of shoes $S_1$ and $S_2$ paired together with prior art tie 11. Prior art tie 11 is attached to shoes $S_1$ and $S_2$ in the following manner. First, tail 39 is threaded through eyelet $E_1$ in shoe $S_1$ and then eyelet $E_2$ in shoe $S_2$. Tail 39 is then inserted into channel 27 of head 21 to form a closed loop. Tail 39 is advanced through bottom wall 23 of head 21 and out through top wall 25 in a forward direction, the forward direction being represented by arrow F in FIG. 3. Drawing strap 31 forward through head 21 decreases the size of the closed loop. Locking tang 29 is designed so as to permit strap 31 to advance forward through head 21. Locking tang 29 is also designed to engage rungs 37 when strap 31 is thrust in the reverse direction, the reverse direction being shown by arrow R in FIG. 3. Therefore, strap 31 can be advanced forward through head 21 to decrease the size of the closed loop, but strap 31 can not be thrust in the reverse direction to increase the size of the closed loop. As a result, once strap 31 is advanced through head 21 to secure shoes $S_1$ and $S_2$ together, shoes $S_1$ and $S_2$ remain paired together until cable tie 11 is severed, which precludes any further use of prior art tie 11.

Strap 31 is capable of advancement through head 21 until projection 49 hits up against bottom wall 23 of head 21.

As can be appreciated, projection 49 limits how far strap 31 can be advanced forward through head 21, thereby limiting the minimum size of the closed loop. Due to the location of projection 49 on strap 31, namely, approximately 26 cm from head 25, shoes $S_1$ and $S_2$ can be moved relative to each other so that they are spaced apart from each other at a distance of approximately 13 cm, the approximate distance required for one to comfortably try on both shoes of a pair at the same time.

Figure 5:
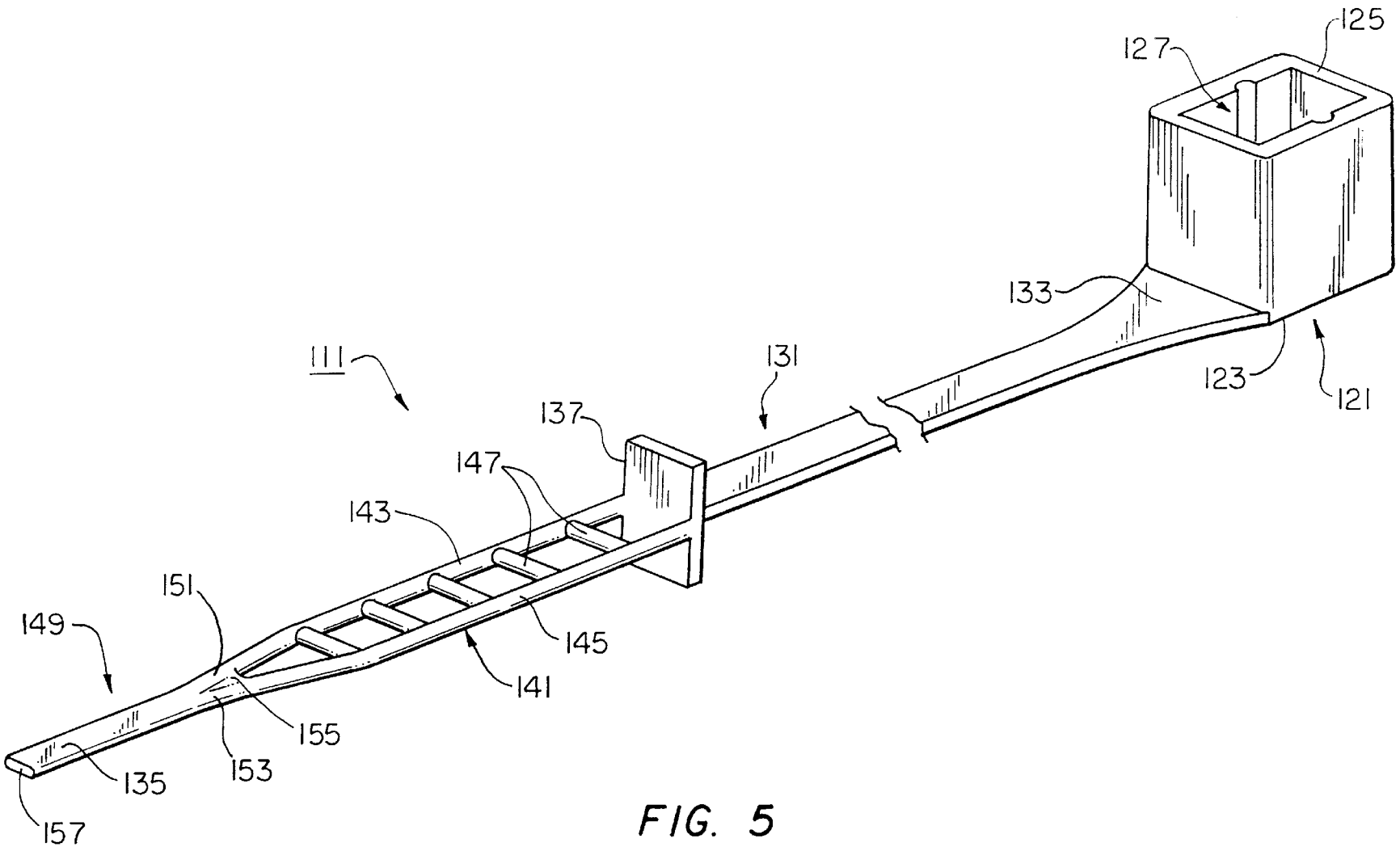
FIG. 5 is a perspective view of a first embodiment of a tie constructed according to the teachings of the present invention for pairing together two objects.
Figure 6:
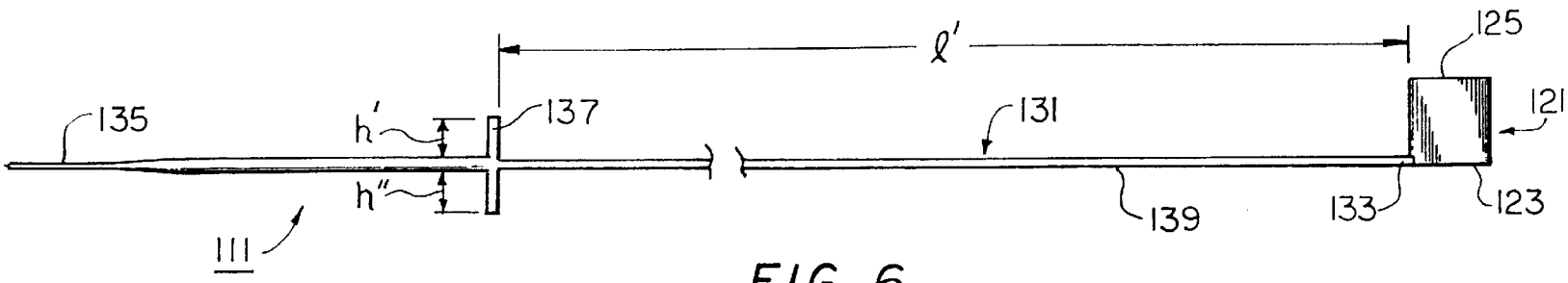
FIG. 6 is a right side view of the tie shown in FIG. 5.
Figure 7:
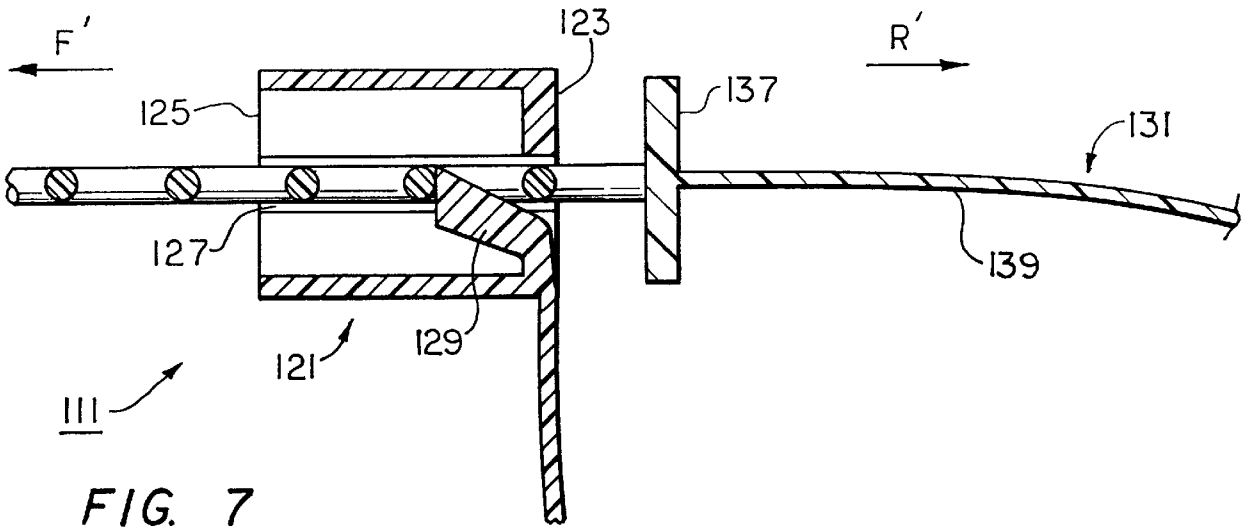
FIG. 7 is a fragmentary, side section view of the tie shown in FIG. 5, the strap being shown inserted through the head.

Referring now to FIGS. 5–7, there is shown a first embodiment of a tie constructed according to the teachings of the present invention for pairing together two objects, the tie being represented generally by reference numeral 111. As will be discussed in detail below, tie 111 is longer in length, less expensive to manufacture and more flexible than prior art tie 11.

Tie 111 includes a head 121 and an attached strap 131.

Head 121 is identical in construction with head 21 of prior art tie 11. Specifically, head 121 is generally rectangular in shape and includes a bottom wall 123, a top wall 125, and an elongated channel 127 which extends through head 121 from bottom wall 123 to top wall 125. Head 121 further includes a locking tang 129 which may be either of the stationary type or the deflectable type.

Strap 131 comprises a first end 133, a second end 135 and an enlarged rectangular projection 137 which is integrally formed on strap 131 at a location between first end 133 and second end 135. First end 133 is integrally formed onto head 121 to make tie 111 a unitary device. Projection 137 serves as a stop when tie 11 is used to pair together two objects, as will be described in detail below. Projection 137 also serves to divide strap 131 into two portions.

The portion of strap 131 from projection 137 to first end 133 is in the form of an elongated, flexible filament 139. Elongated, flexible filament 139 is narrow in thickness, narrow in width, and has a generally uniform, rectangularly-shaped cross-section.

It should be noted that elongated filament 139 is not limited to having a generally rectangularly-shaped cross-section. Rather, elongated filament 139 could have a differently shaped cross-section (i.e., circular or elliptical) without departing from the spirit of the present invention.

The portion of strap 131 from projection 137 to second end 135 comprises a ladder structure 141. Ladder structure 141 comprises a pair of side rails 143 and 145 and a plurality of rungs 147. Ladder structure 141 terminates into a elongated webbed tail 149 which is formed at second end 135. Tail 149 is formed by extensions 151 and 153 of side rails 143 and 145, respectively. Webbing 155 occupies the interval between extension side rails 151 and 153. Tail 149 tapers into a narrow tip 157 approximately 3 mm in width.

As shown in FIG. 6, projection 137 protrudes upward above rungs 147 a distance h' of approximately 1 mm. Similarly, projection 137 protrudes downward beneath rungs 147 a distance h" of approximately 1 mm.

Strap 131 can be molded using conventional molding techniques. As can be appreciated, the simplicity of the size and shape of elongated filament 139 considerably simplifies the process for molding strap 131 when compared to the process for molding strap 31 of prior art tie 11. As a consequence, tie 111 is considerably cheaper to mold than prior art tie 11, which is desirable.

Upon completion of the molding process, filament 139 of tie 111 can be stretched using conventional stretching techniques so that projection 137 is a distance l' of approximately 59.5 cm from head 21 after the stretching process, strap 131 having a total length of approximately 63.3 cm. Strap 131 is preferably constructed of a molecular reorientable type material, such as nylon, polypropylene, polyester, urethane, or the like. This material, upon stretching, not only reduces the volume per unit length of the strap but also provides enhanced physical properties, such as an increase in tensile and shear strength.

It should be noted that the thin size and shape of elongated filament 139 makes strap 131 of tie 111 much more flexible than strap 31 of prior art tie 11, which is desirable. Increased levels of flexibility in strap 131 of tie 111 simplifies the ease in which tie 111 can be formed into a closed loop during use.

It should also be noted that the particular size and shape of elongated filament 139 enables filament 139 to be stretched a considerable length. In particular, due to the construction of elongated filament 139, strap 131 of tie 111 can be stretched a length much longer length than strap 31 of prior art tie 11 without the need for additional materials, which is desirable.

In use, tie 111 functions similarly to tie 11 to pair together two objects such as shoes, sneakers, or sandals. Specifically, tie 111 can be used to pair together two shoes in the following manner. First, tail 149 is threaded through an eyelet in each shoe. Tail 149 is then inserted into channel 127 of head 121 to form a closed loop. Tail 149 is advanced through bottom wall 123 of head 121 and out through top wall 125 in a forward direction, the forward direction being represented by arrow F' in FIG. 7. Drawing strap 131 forward through head 121 decreases the size of the closed loop. Locking tang 129 is designed so as to permit strap 131 to advance forward through head 121. Locking tang 129 is also designed to engage rungs 147 when strap 131 is thrust in the reverse direction, the reverse direction being shown by arrow R' in FIG. 7. Therefore, strap 131 can be advanced forward through head 121 to decrease the size of the closed loop, but strap 131 can not be thrust in the reverse direction to increase the size of the closed loop. As a result, once strap 131 is advanced through head 121 to secure the pair of shoes together, the shoes remain paired together until cable tie 111 is severed.

Strap 131 is capable of advancement through head 121 until projection 137 hits up against bottom wall 123 of head 121.

It should be noted that, because strap 131 of tie 111 is considerably longer than strap 31 of tie 11, tie 111 can be used to pair together two objects but, at the same time, can enable the two objects to be separated approximately 29.5 cm apart from one another. To the contrary, prior art tie 11 can be used to pair together two objects but can only separate the two objects approximately 13 cm apart from one another.

The increase in the length of strap 131 of tie 111 compared to the length of strap 31 of prior art tie 11 is significant in that tie 111 pairs together two objects, such as shoes, without prohibiting a prospective buyer from having the opportunity to put on the shoes and comfortably walk around in order to sample the comfort of the shoes, which is desirable. To the contrary, prior art tie 11 does not allow a prospective buyer to walk in the shoes with the freedom that tie 111 permits. Rather, prior art tie 11 allows a prospective buyer to put on both shoes comfortably, but does not comfortably enable the buyer to walk around in the shoes.

Figure 8:
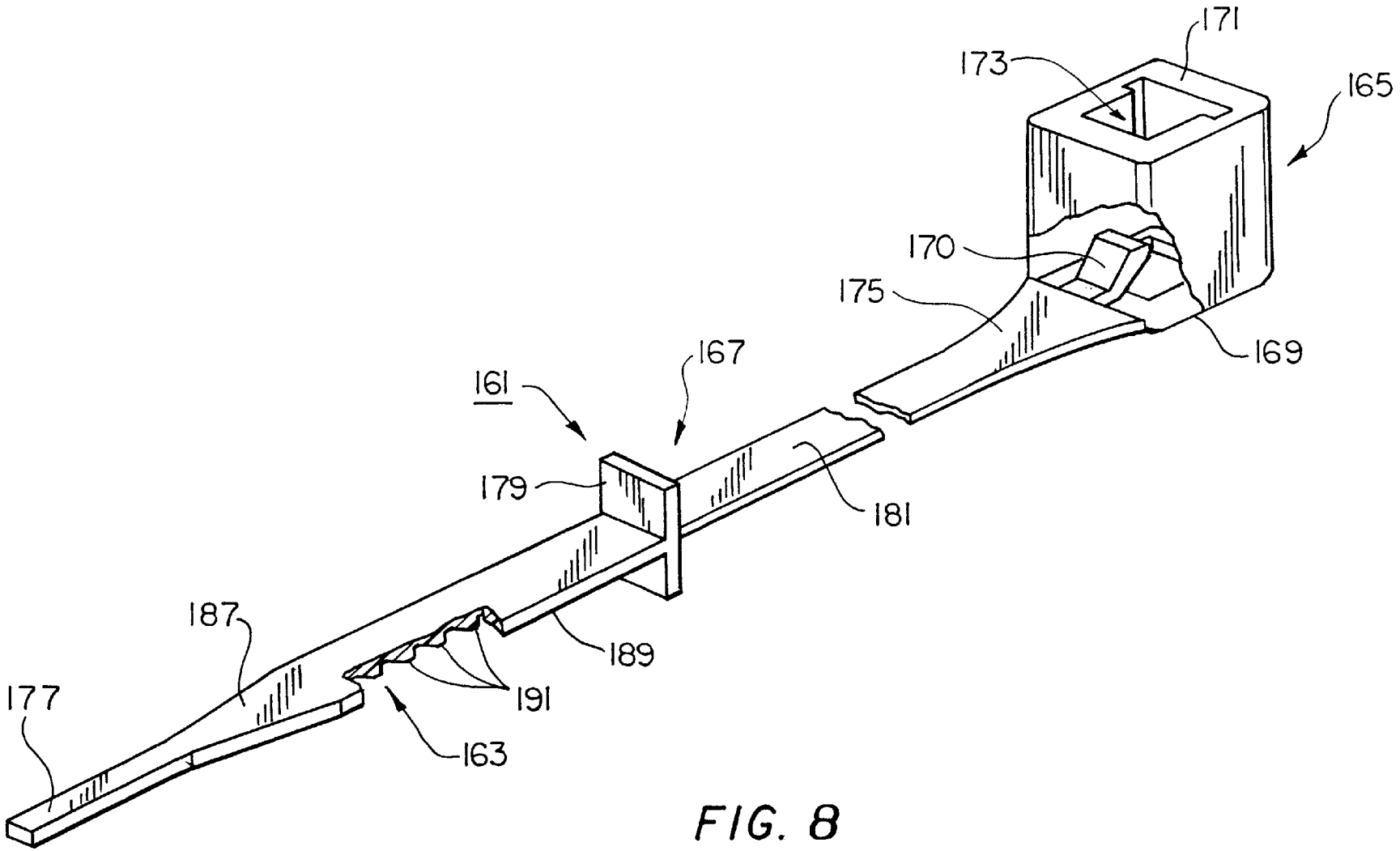
FIG. 8 is a perspective view, broken away in part, of a second embodiment of a tie constructed according to the teachings of the present invention for pairing together two objects.

It should be noted that tie 111 is not limited to ladder structure 141 as means for locking strap 131 within locking head 121. To the contrary, tie 111 may utilize alternative means for lockably retaining strap 131 within head 121. For example, FIG. 8 discloses a second embodiment of a tie constructed according to the teachings of the present invention for pairing together two objects, the tie being represented generally by reference numeral 161.

The principal distinction between tie 161 and tie 111 is that tie 161 comprises a ratchet structure 163 rather than ladder structure 141 of tie 111.

Tie 161 comprises a head 165 and an attached strap 167.

Head 165 is similar in construction with head 121 of tie 111. Head 165 is generally rectangular in shape and includes a bottom wall 169, a top wall 171 and an elongated channel 173 which extends through head 165 from bottom wall 169 to top wall 171. Head 165 further includes a locking tang, or pawl, 170 which is either of the stationary type or the deflectable type.

Strap 167 comprises a first end 175, a second end 177 and an enlarged rectangular projection 179 which is formed on strap 167 at a location between first end 175 and second end 177. First end 175 is integrally formed onto head 165 to make tie 161 a unitary device.

Projection 179 is identical in construction and function with projection 137 of tie 111.

Projection 179 divides strap 167 into two portions. The portion of of strap 167 from projection 179 to first end 175 is in the form of an elongated, flexible filament 181 which is identical in construction with filament 139 of tie 111. Elongated, flexible filament 181 is narrow in thickness, narrow in width and has a generally uniform, rectangularly-shaped cross-section.

As noted above, the portion of strap 167 from projection 179 to second end 177 comprises ratchet structure 163 as opposed to the ladder structure 141 of tie 111. Ratchet structure 163 comprises a pair of side rails (not shown), a top planar surface 187, a bottom planar surface 189 and a plurality of ratchet-shaped teeth 191 spaced along the length of bottom surface 189.

In use, insertion of strap 167 through elongated channel 173 of head 165 causes tie 161 to take the form of a closed loop. Positioned as such, locking tang 170 within head 165 engages ratchet-shaped teeth 191 so as to lockably retain strap 167 within head 165. As in tie 111, projection 179 of tie 161 serves to limit how far strap 167 can be advanced forward through head 165, thereby limiting the minimum size of the closed loop formed by tie 161.

The embodiments of the present invention described above are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A tie for pairing together two objects comprising:

a. a head having an elongated channel extending therethrough, b. a locking tang within said head, c. a strap having a first end and a second end, the first end being integrally formed onto said head, and d. a projection formed on said strap between the first end and the second end approximately 59.5 cm from the head, e. the portion of said strap from said projection to the first end being in the shape of a filament narrower in thickness than the portion of the strap from the projection to the second end, f. the portion of said strap from said projection to the second end being engagable by said locking tang when said strap is inserted into and through the elongated channel to form a closed loop, wherein increased insertion of said strap through the elongated channel decreases the size of the closed loop, said projection limiting the minimum size of the closed loop which can be formed.

2. The tie as claimed in claim 1 wherein the portion of said strap from said projection to said second end comprises a ratchet structure having teeth which are sequentially engaged by said locking tang when said strap is inserted into and through the elongated channel.

3. A tie for pairing together two objects comprising:

a. a head having an elongated channel extending therethrough, b. a locking tang within said head, c. a strap having a first end and a second end, the first end being integrally formed onto said head, and d. a projection formed on said strap between the first end and the second end approximately 59.5 cm from the head, e. the portion of said strap from said projection to the first end being comprising an elongated filament narrower in width than the portion of the strap from the projection to the second end, f. the portion of said strap from said projection to the second end comprising means engagable by said locking tang when said strap is inserted into and through the elongated channel to form a closed loop, wherein increased insertion of said strap through the elongated channel decreases the size of the closed loop, said projection limiting the minimum size of the closed loop which can be formed.

4. The tie as claimed in claim 3 wherein the means engagable by said locking tang on the portion of said strap from said projection to the second end is a ratchet structure, the ratchet structure having teeth which are sequentially engaged by said locking tang when said strap is inserted into and through the elongated channel.

* * * * *